US006079064A

United States Patent [19]

Hsieh

[11] Patent Number: 6,079,064

[45] Date of Patent: Jun. 27, 2000

[54] FOLDABLE BED ASSEMBLY

[76] Inventor: Chuan Chi Hsieh, No. 71, Nan An Road, Kaohsiung Hsien, Taiwan

[21] Appl. No.: 09/201,761

[22] Filed: Dec. 1, 1998

[51] Int. Cl.[7] ..... A47C 17/00

[52] U.S. Cl. ..... 5/114; 110/111; 110/45

[58] Field of Search ..... 5/110, 111, 112, 5/114, 45, 174, 178; 297/16.1, 19, 29, 31

[56] References Cited

U.S. PATENT DOCUMENTS

| | | | |
|---|---|---|---|
| 2,678,085 | 5/1954 | Minno | 5/110 X |
| 3,789,437 | 2/1974 | Garte | 5/114 X |
| 5,272,777 | 12/1993 | Favagrossa | 5/110 |

*Primary Examiner*—Michael F. Trettel
*Assistant Examiner*—Fredrick Conley
*Attorney, Agent, or Firm*—Rosenberg, Klein & Lee

[57] ABSTRACT

A foldable bed assembly includes a mattress, a mediate supporter, a front frame having a first end pivotally connected to the mediate supporter, and a rear frame having a first end pivotally connected to the mediate support. A positioning plate has a first end pivotally connected to the front frame. A rear frame has a first end pivotally connected to the mediate supporter. A front leg structure includes an upper portion pivotally connected to the second end of the front frame. The front leg structure further includes a base portion securely located on the ground. A rear leg frame is securely attached to the second end of the rear frame. A handle includes a first end pivotally connected to one of the front frame and the rear frame. When the bed assembly is in an extended status, a second end of the positioning plate engages with a peg on the upper portion of the front leg structure, and a second end of the handle engages with an engaging member on the front frame. When the bed assembly is in a folded status, the second end of the positioning plate engages with a peg on the rear frame, the second end of the handle engages with an engaging member on the rear frame, and the mediate section of the handle together with the base portion of the front leg structure provide a support for the folded bed assembly.

4 Claims, 7 Drawing Sheets

FOLDABLE BED ASSEMBLY

BACKGROUND OF THE INVENTION

1. Field of the Invention

The present invention relates to a foldable bed assembly that can be used as a chair and has increased stability and safety.

2. Description of the Related Art

FIG. 7 of the drawings illustrates a typical foldable bed assembly that includes a mattress 1', a front frame 2', a rear frame 3', and a middle supporter 6'. Attached to the front frame 2' are two legs 4' each having a caster (not labeled) attached to a lower end thereof Attached to the rear frame 3' is a leg structure 5' having a supporting frame 51' for supporting the folded bed assembly. The front frame 2' includes an inner frame that has an end pivotally connected to a front section thereof A spring 21' is connected between a middle point of a lower rod of the middle supporter 6' and a middle point of a front end of the front frame 2', while another spring 31' is connected between the middle point of the lower rod of the middle supporter 6' and a middle point of a rear end of the rear frame 3'. Two handles 22' are respectively attached to two lateral sides of the front frame 2'. The bed assembly tends to swivel (FIG. 8) if it is impinged during folding, as the rear frame 3' is pivoted to the leg structure 5'. In addition, the bed assembly can be used only when it is in an unfolded status that occupies a considerable space. The present invention is intended to provide an improved foldable bed assembly to solve these problems.

SUMMARY OF THE INVENTION

It is a primary object of the present invention to provide an improved foldable bed assembly that can be used even if in a folded status.

It is another object of the invention to provide an improved foldable bed assembly that has increased stability and safety.

A foldable bed assembly in accordance with the present invention comprises:

a mattress, a mediate supporter, a front frame having a first end pivotally connected to the mediate supporter and a second end, a positioning plate having a first end pivotally connected to the front frame and a second end, a first engaging member provided on the front frame, a rear frame having a first end pivotally connected to the mediate supporter and a second end, the rear frame including a first peg formed thereon, a front leg structure including a base portion and an upper portion, the upper portion being pivotally connected to the second end of the front frame and including a second peg formed thereon, a rear leg frame securely attached to the second end of the rear frame, a handle including a first end pivotally connected to one of the front frame and the rear frame, a second end, and a mediate section, wherein when the bed assembly is in an extended status, the second end of the positioning plate engages with the second peg on the front leg structure, and the second end of the handle engages with the first engaging member on the front frame, and wherein when the bed assembly is in a folded status, the second end of the positioning plate engages with the first peg on the rear frame, the second end of the handle engages with the second engaging member on the rear frame, and the mediate section of the handle together with the base portion of the front leg structure provide a support for the folded bed assembly.

In accordance with a preferred embodiment of the invention, a foldable bed assembly comprises:

a mattress, a mediate supporter, a front frame having a first end pivotally connected to the mediate supporter and a second end, the front frame further including two lateral sides, two positioning plates each having a first end pivotally connected to an associated said lateral side of the front frame and a second end, a first engaging member provided on each said lateral side of the front frame, a rear frame having a first end pivotally connected to the mediate supporter and a second end, the rear frame including a first peg formed thereon, the rear frame further including two lateral sides, a front leg structure including a base portion and two limbs extending upwardly from the base portion, each said limb being pivotally connected to the associated lateral side of the front frame, each said limb further including a second peg and a third peg formed thereon, a second engaging member provided on each said lateral side of the rear frame, a second engaging member provided on each said lateral side of the rear frame, a rear leg frame securely attached to the second end of the rear frame, two handles each including a first end pivotally connected to the associated lateral side of the front frame, a second end, and a mediate section, wherein when the bed assembly is in an extended status, the second end of each said positioning plate engages with the second peg on an associated said limb of the front leg structure, and the second end of each said handle engages with an associated said first engaging member on the front frame, and wherein when the bed assembly is in a folded status, the second end of each said positioning plate engages with an associated said first peg on the rear frame, the second end of each said handle engages with an associated said second engaging member on the rear frame, the lateral sides of the front frame bear against the third pegs on the limbs, respectively, and the mediate section of each said handle together with the base portion of the front leg structure provide a support for the folded bed assembly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
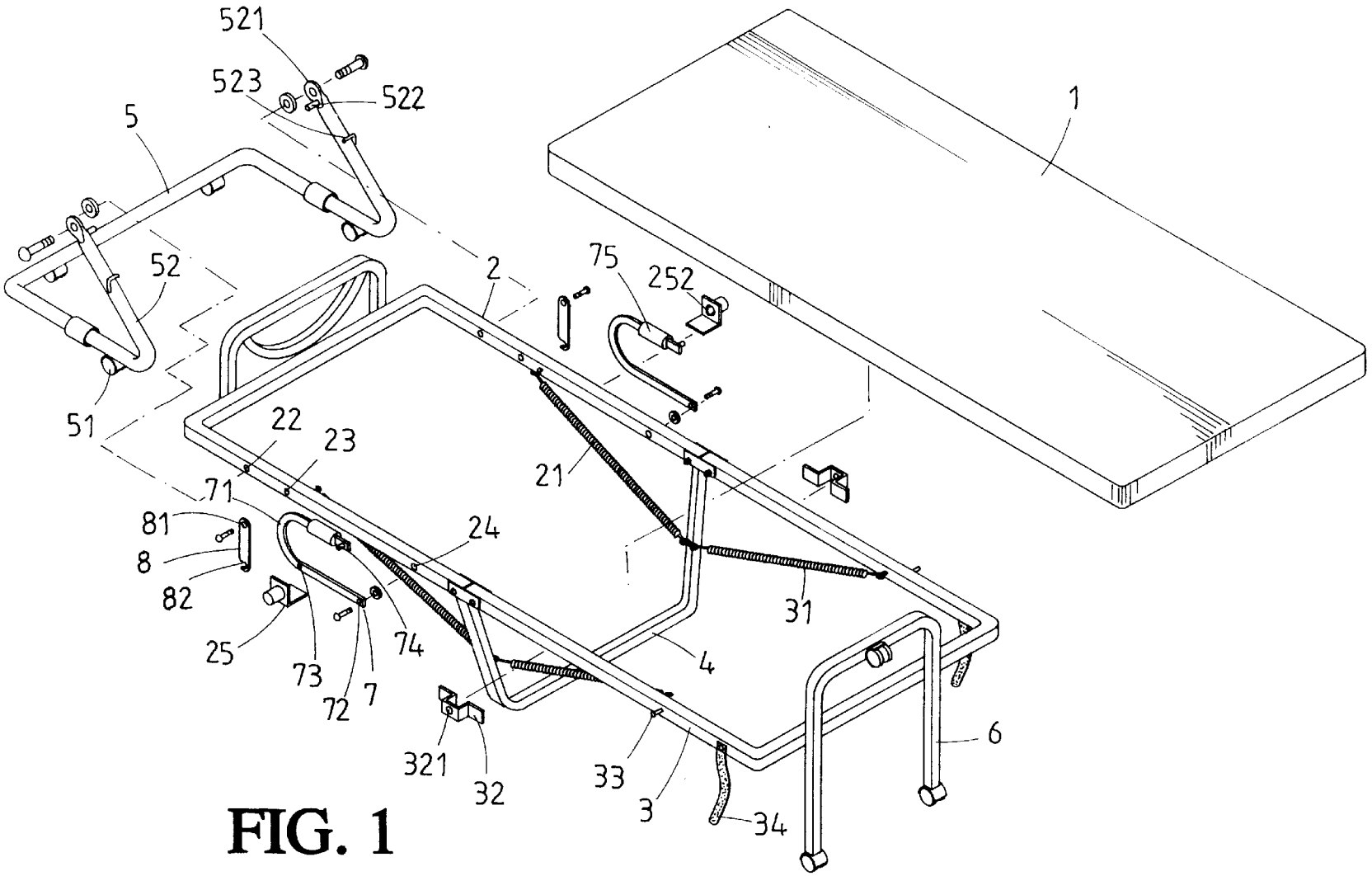
FIG. 1 is an exploded perspective view of a foldable bed assembly in accordance with the present invention.
Figure 2:
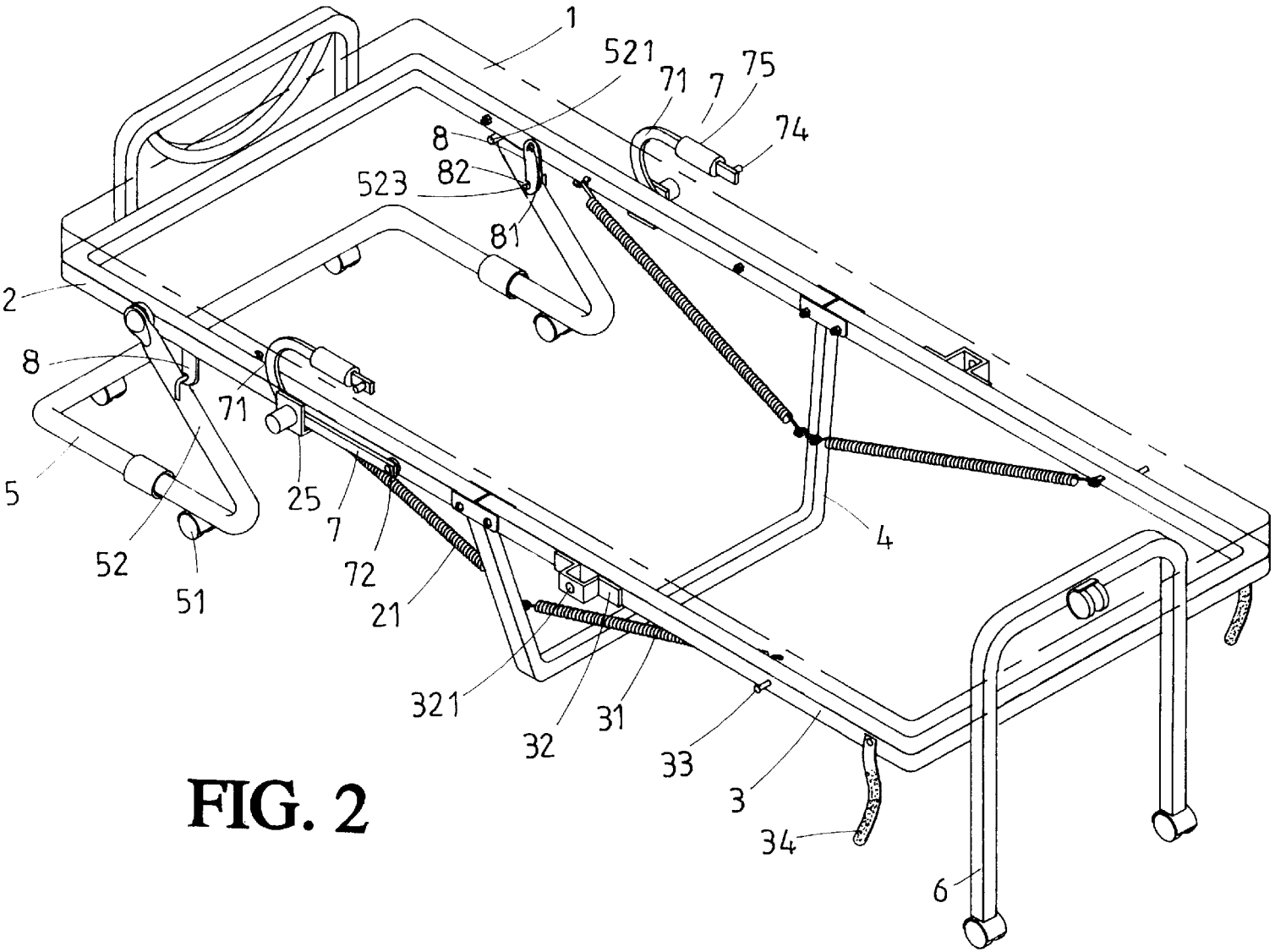
FIG. 2 is a perspective view of the foldable bed assembly in accordance with the present invention.

Referring to FIGS. 1 to 6 and initially to FIGS. 1 and 2, a foldable bed assembly in accordance with the present invention generally includes a mattress 1, a mediate supporter 4, a front frame 2 having a first end pivotally connected to the mediate supporter 4, and a rear frame 3 having a first end pivotally connected to the mediate supporter 4. A front leg structure 5 is attached to a second end of the front frame 2 and includes a substantially U-shaped base portion located on the ground. A number of casters 51 are mounted to an underside of the base portion of the front leg structure 5. Two limbs 52 extend upwardly from the base portion of the front leg structure 5 and are connected to two lateral sides of the front frame 2, respectively. In this embodiment, each limb 52 includes a distal end 521 pivotally connected to the front frame 2 by a screw (not labeled) that extends through a hole 22 defined in the associated lateral side of the front frame 2. In addition, each limb 5 further includes an upper peg 522 and a lower peg 523. Each lateral side of the front frame 2 further includes another hole 23. Two positioning plates 8 are provided, each having a first end 81 pivoted to the hole 23 by a screw and a second end 82 with a notch (not labeled). When in an extended status shown in FIG. 2, the lower peg 523 of each limb 52 engages with the notch of the associated positioning plate 8 to provide increased stability and safety. When in a folded status, the upper peg 522 of each limb 52 provides a support for the associated lateral side of the front frame 2. Each lateral side of the front frame 2 further includes an engaging member 25 attached thereto, each engaging member 25 including a protrusion 252, which will be described later.

A rear leg structure 6 is securely attached to a second end of the rear frame 3. The rear leg frame 6 includes two legs (not labeled) each having a wheel or caster (not labeled) mounted to a lower end thereof As shown in FIG. 1, two springs 31 are interconnected between the rear frame 3 and the mediate supporter 4, and two other springs 21 are interconnected between the front frame 2 and the mediate supporter 4. This arrangement may provide assistance to the user during folding by moving the two frames 2 and 3 toward each other. Each lateral side of the rear frame 3 further includes a peg 33 formed thereon and an engaging member 32 attached thereto, each engaging member 32 having an engaging hole 321. In addition, each lateral side of the rear frame 3 has a strap 34 attached thereto, which will be described later.

Two handles 7 are respectively attached to two lateral sides of the front frame 2. Each handle 7 is substantially U-shaped and includes a longer section, a shorter section, and a mediate section 71. The shorter section of each handle 7 includes an elastic button 74 for releasably engaging with the engaging hole 321 of an associated engaging member 32 on the rear frame 3. The longer section of each handle 7 includes a hole 73 for releasably engaging with the protrusion 252 of an associated engaging member 25. The distal end of the longer section of each handle 7 further includes a hole 72 so as to be pivotally attached to an associated lateral side of the front frame 2 by a screw (not labeled) that extends through a corresponding hole 24 in the associated lateral side of the front frame 2. When the bed assembly is in the folded status, the mediate section 71 locates on the ground and together with the base portion of the front leg structure 5 provide a reliable support, best shown in FIG. 6. Each handle 7 further includes a grasp portion 75 for grasp.

Figure 3:
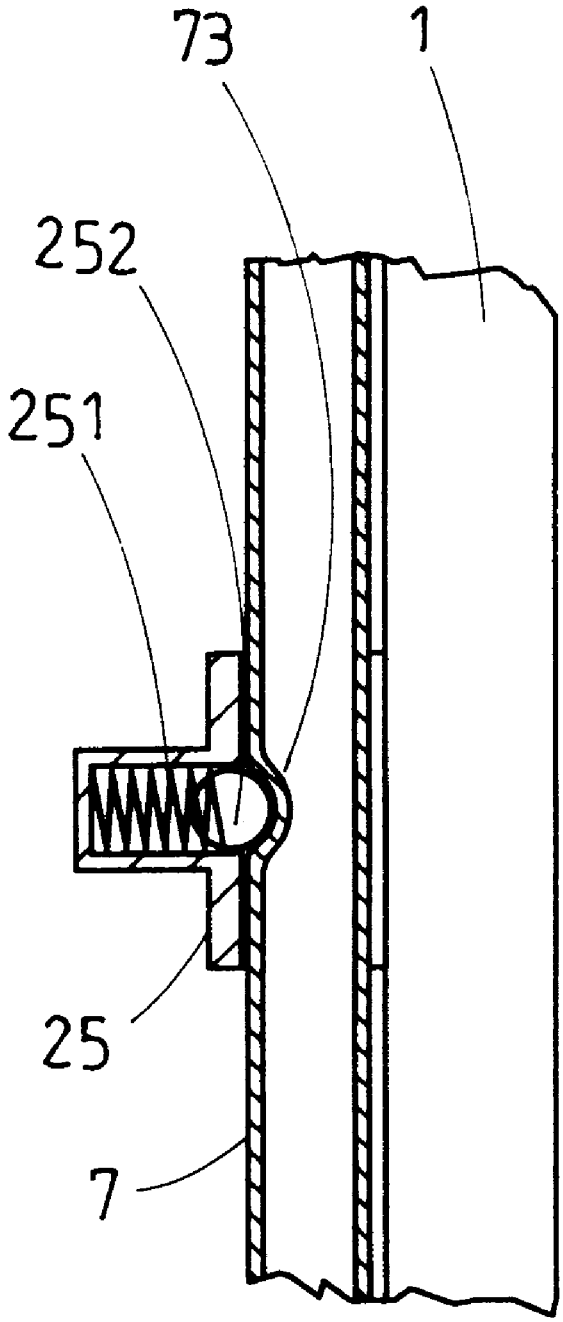
FIG. 3 is a partial sectional view illustrating engagement between a handle and a front frame of the foldable bed assembly in accordance with the present invention.

Referring to FIGS. 2 and 3, when extended, the bed assembly is stable, as the notch 82 of each positioning plate 8 engages with the lower peg 523 of an associated limb 52 of the front leg structure 5. In addition, each handle 7 is securely retained in place, as the hole 73 engages with the protrusion 252 of an associated engaging member 25.

Figure 4:
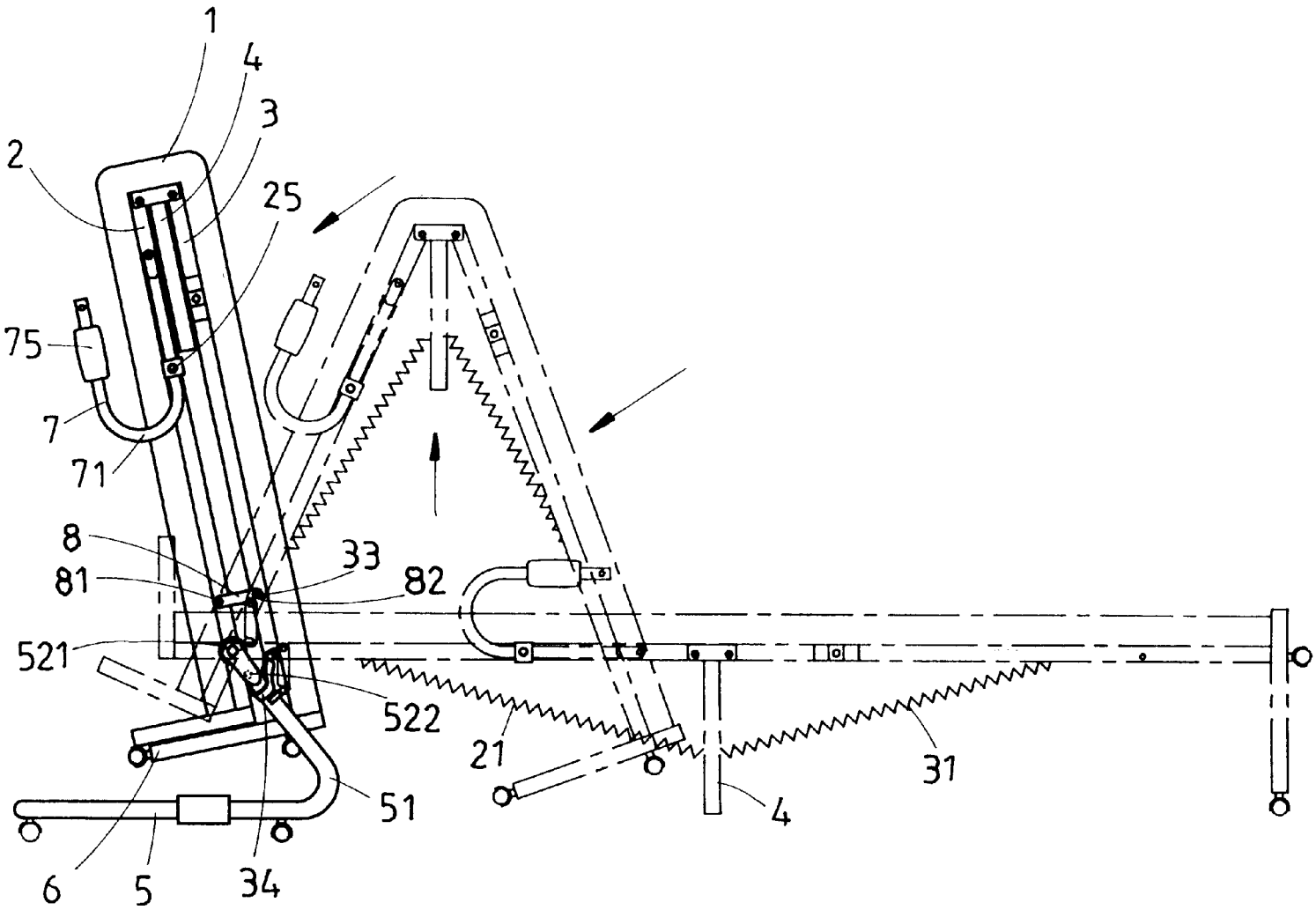
FIG. 4 is a side view illustrating folding of the foldable bed assembly in accordance with the present invention.

When folding, referring to FIG. 4, the mediate support 4 is lifted and the front frame 2 and the rear frame 3 are moved toward each other under assistance by the springs 21 and 31. The folded front and rear frames 2 and 3 are then pivoted about the front leg structure 5 until the lateral sides of the front frame 2 bear against the upper pegs 522 of the front leg structure 5, respectively. Each strap 34 is then wound through the front leg structure 5. Each strap 34 may include hooks and loops fasteners thereon so as tie the front leg structure 5 up. The notched end 82 of each positioning plate 8 engages with an associated peg 33 on the rear frame 3 and thus prevents from inadvertent unfolding of the folded bed assembly.

Figure 5:
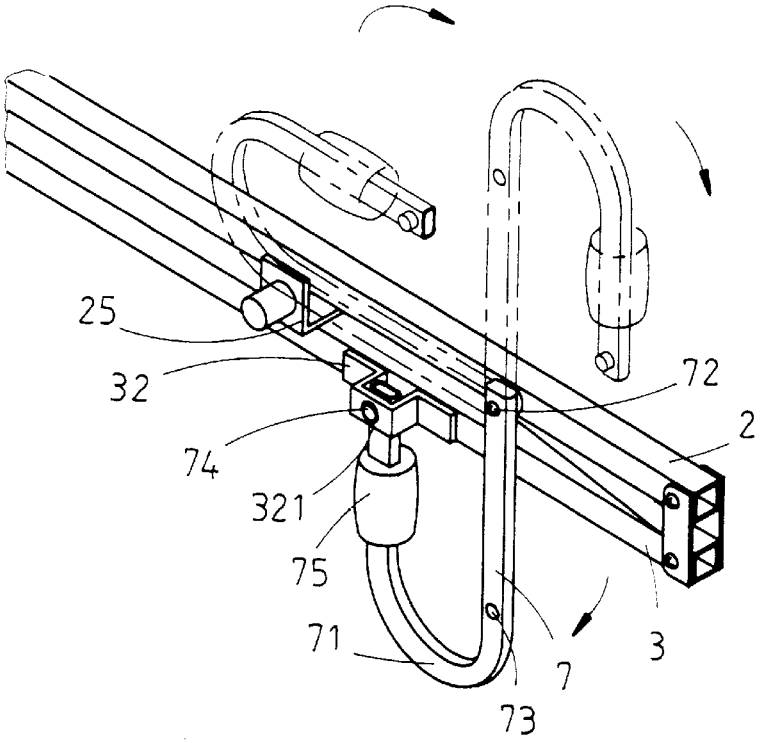
FIG. 5 is a partial perspective view illustrating operation of the handle.
Figure 6:
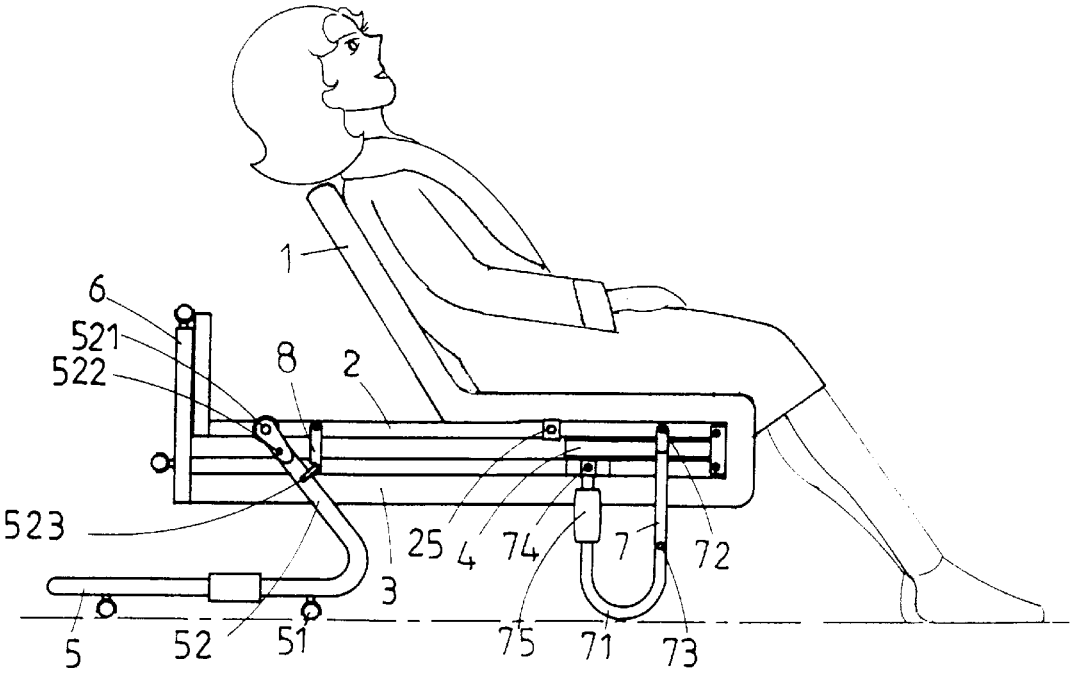
FIG. 6 is a side view illustrating another use of the folded bed assembly in accordance with the present invention.
Figure 7:
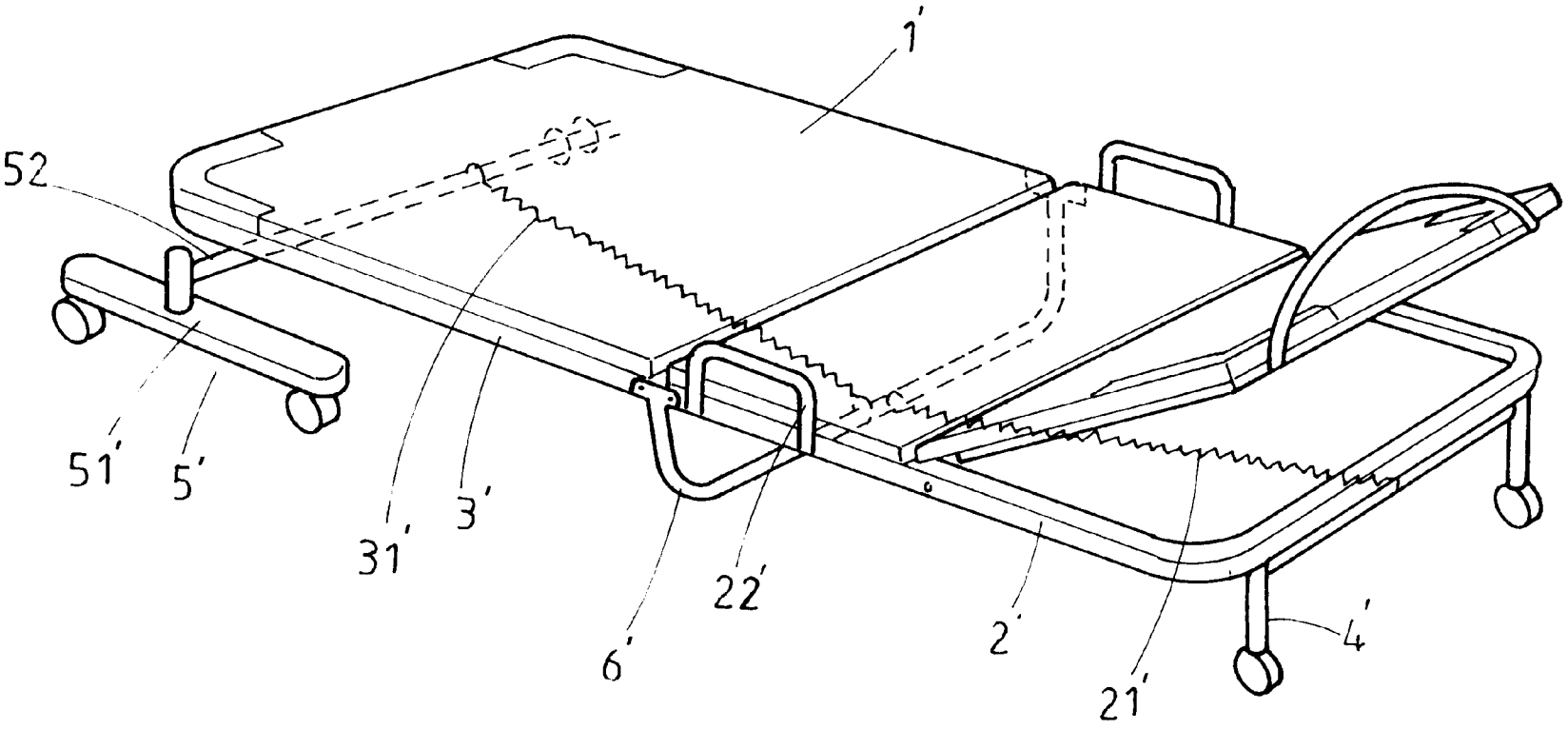
FIG. 7 PRIOR ART
FIG. 7 is a perspective view of a conventional foldable bed assembly.
Figure 8:
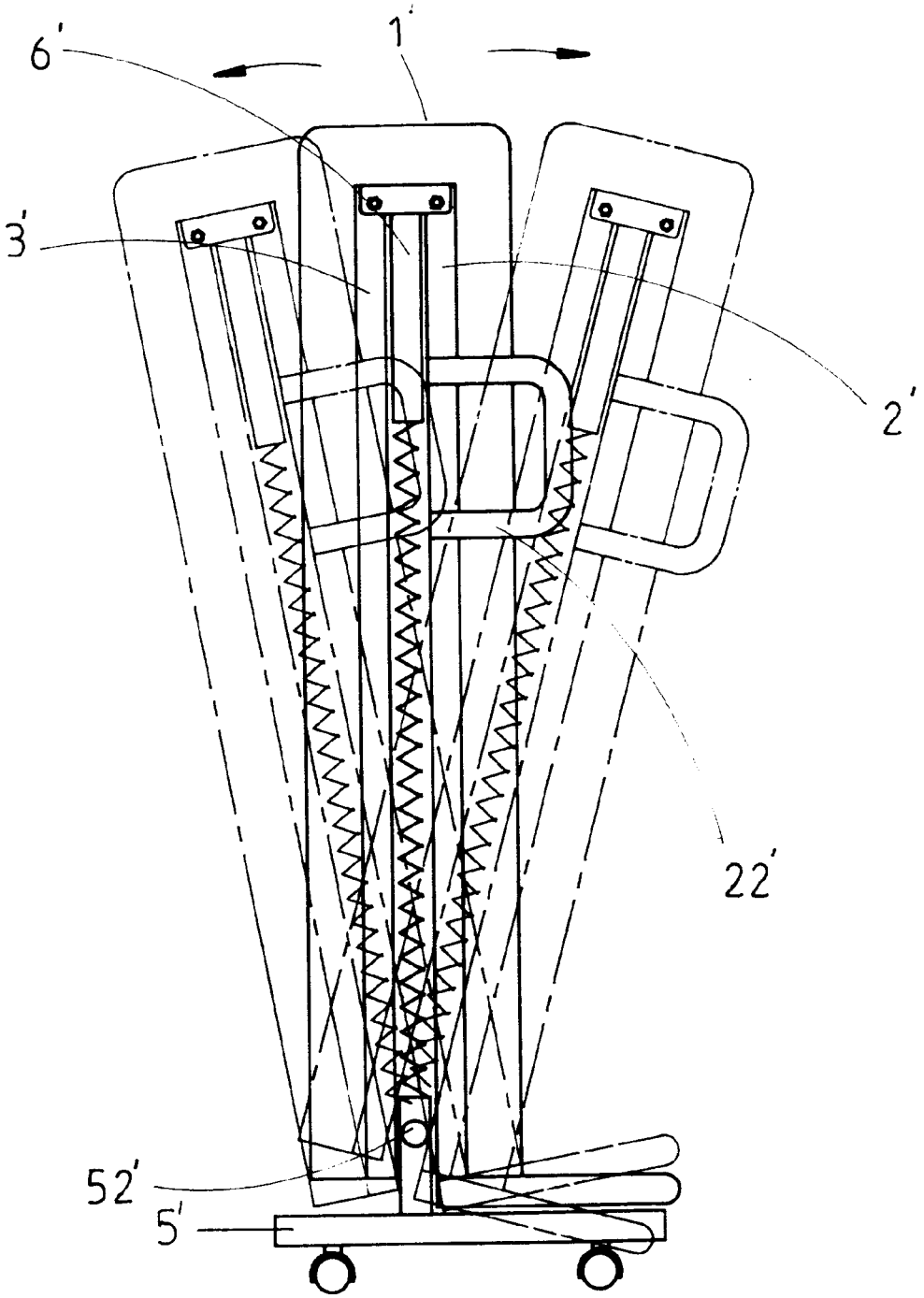
FIG. 8 PRIOR ART
FIG. 8 is a side view of the conventional foldable bed assembly.

Referring to FIGS. 5 and 6, the user may apply a force to each handle 7 to disengage the hole 73 from the engaging member 25, and then rotate the handle 7 along a direction indicated by the arrows in FIG. 5 to make the elastic button 73 of the handle 7 engage with the engaging member 32. In this status, as shown in FIG. 6, the mediate section 71 locates on the ground and together with the base portion of the front leg structure 5 provide a reliable support. The length of the mediate section 71 matches the height of the front leg structure 5.

Still referring to FIG. 6, when folded, the bed assembly of the present invention still can be used as a chair.

According to the above description, by means of provision of the above-mentioned engaging members, positioning plates, and pegs, it is appreciated that the foldable bed assembly has improved stability and safety not only in the extended status but also in the folded status. In addition, the straps 34 that are wound around the font leg structure prevent the folded bed assembly from swiveling even if the folded bed assembly is impinged. The foldable bed assembly can be used as a chair when in the folded status in which the handles provide an additional support to prevent the mattress from contacting with the ground.

Although the invention has been explained in relation to its preferred embodiment, it is to be understood that many other possible modifications and variations can be made without departing from the spirit and scope of the invention as hereinafter claimed.

What is claimed is:

1. A foldable bed assembly comprising:

a mattress, a mediate supporter;

a front frame having a first end pivotally connected to the mediate supporter and a second end, a positioning plate having a first end pivotally connected to the front frame and a second end, a first engaging member provided on the front frame, a rear frame having a first end pivotally connected to the mediate supporter and a second end, the rear frame including a first peg formed thereon, a front leg structure including a base portion and an upper portion, the upper portion being pivotally connected to the second end of the front frame and including a second peg formed thereon, a second engaging member provided on the rear frame, a rear leg frame securely attached to the second end of the rear frame, a handle including a first end pivotally connected to one of the front frame and the rear frame, a second end, and a mediate section, wherein when the bed assembly is in an extended status, the second end of the positioning plate engages with the second peg on the front leg structure, and the second end of the handle engages with the first engaging member on the front frame, and wherein when the bed assembly is in a folded status, the second end of the positioning plate engages with the first peg on the rear frame, the second end of the handle engages with the second engaging member on the rear frame, and the mediate section of the handle together with the base portion of the front leg structure provide a support for the folded bed assembly.

2. The foldable bed assembly as claimed in claim 1, wherein the base portion of the front leg structure further includes at least one caster mounted to an underside thereof.

3. A foldable bed assembly comprising:

a mattress, a mediate supporter, a front frame having a first end pivotally connected to the mediate supporter and a second end, the front frame further including two lateral sides, two positioning plates each having a first end pivotally connected to an associated said lateral side of the front frame and a second end, a first engaging member provided on each said lateral side of the front frame, a rear frame having a first end pivotally connected to the mediate supporter and a second end, the rear frame including a first peg formed thereon, the rear frame further including two lateral sides, a front leg structure including a base portion and two limbs extending upwardly from the base portion, each said limb being pivotally connected to the associated lateral side of the front frame, each said limb further including a second peg and a third peg formed thereon, a second engaging member provided on each said lateral side of the rear frame, a rear leg frame securely attached to the second end of the rear frame, two handles each including a first end pivotally connected to the associated lateral side of the front frame, a second end, and a mediate section, wherein when the bed assembly is in an extended status, the second end of each said positioning plate engages with the second peg on an associated said limb of the front leg structure, and the second end of each said handle engages with an associated said first engaging member on the front frame, and wherein when the bed assembly is in a folded status, the second end of each said positioning plate engages with an associated said first peg on the rear frame, the second end of each said handle engages with an associated said second engaging member on the rear frame, the lateral sides of the front frame bear against the third pegs on the limbs, respectively, and the mediate section of each said handle together with the base portion of the front leg structure provide a support for the folded bed assembly.

4. The foldable bed assembly as claimed in claim 1, wherein the base portion of the front leg structure further includes at least one caster mounted to an underside thereof.

* * * * *